US010816218B2

(12) United States Patent
Langhammer et al.

(10) Patent No.: US 10,816,218 B2
(45) Date of Patent: Oct. 27, 2020

(54) EXHAUST CLOSURE SYSTEM FOR A COOKING OVEN

(71) Applicant: ELECTROLUX APPLIANCES AKTIEBOLAG, Stockholm (SE)

(72) Inventors: Klaus Langhammer, Rothenburg ob der Tauber (DE); Trevor Specht, Rothenburg ob der Tauber (DE); Reiner Brenz, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 12 days.

(21) Appl. No.: 15/579,272

(22) PCT Filed: Jun. 14, 2016

(86) PCT No.: PCT/EP2016/063561
§ 371 (c)(1),
(2) Date: Dec. 4, 2017

(87) PCT Pub. No.: WO2017/001183
PCT Pub. Date: Jan. 5, 2017

(65) Prior Publication Data

US 2018/0163974 A1 Jun. 14, 2018

(30) Foreign Application Priority Data

Jul. 2, 2015 (EP) ..... 15174956

(51) Int. Cl.
*F24C 15/20* (2006.01)

(52) U.S. Cl.
CPC ..... *F24C 15/2007* (2013.01); *F24C 15/2014* (2013.01)

(58) Field of Classification Search
CPC ..... F24C 15/2007; F24C 15/2014; F24C 15/2021; F24C 15/20; F24B 1/1806
(Continued)

(56) References Cited

U.S. PATENT DOCUMENTS 741,474 A 10/1903 Ferry
1,169,694 A 1/1916 Swisher
(Continued)

FOREIGN PATENT DOCUMENTS

CN 202229273 U 5/2012
EP 2713109 4/2014

OTHER PUBLICATIONS

International Search Report and Written Opinion for PCT/EP2016/063561 dated Aug. 31, 2016, 8 pages.
(Continued)

*Primary Examiner* — Grant Moubry
*Assistant Examiner* — Rabeeul I Zuberi
(74) *Attorney, Agent, or Firm* — Pearne & Gordon LLP

(57) ABSTRACT

The present invention relates to an exhaust closure system (10) for a cooking oven. Said exhaust closure system (10) is inter-connectable or interconnected between a top wall (30) of an oven cavity (40) and an exhaust channel. The exhaust closure system (10) comprises a lower casing (12) attachable or attached on the top wall (30) of the oven cavity (40) and including at least one inlet opening (22) in its bottom side. The exhaust closure system (10) comprises an upper casing (14) connectable or connected to the exhaust channel and including at least one outlet opening (24) in its top side. The lower casing (12) and the upper casing (14) are permanently or detachably jointed and form a housing of the exhaust closure system (10). A stationary plate (16) and a sliding plate (18) are arranged inside the housing and between the inlet opening (22) and the outlet opening (24). The stationary plate (16) and the sliding plate (18) lie against each other and include at least one opening (26, 28) in each case. The sliding plate (18) is slidable relating to the stationary plate (16) between a closed state and an opened state. The at least one opening (26) of the stationary plate (16) is covered by
(Continued)

Figure 1:
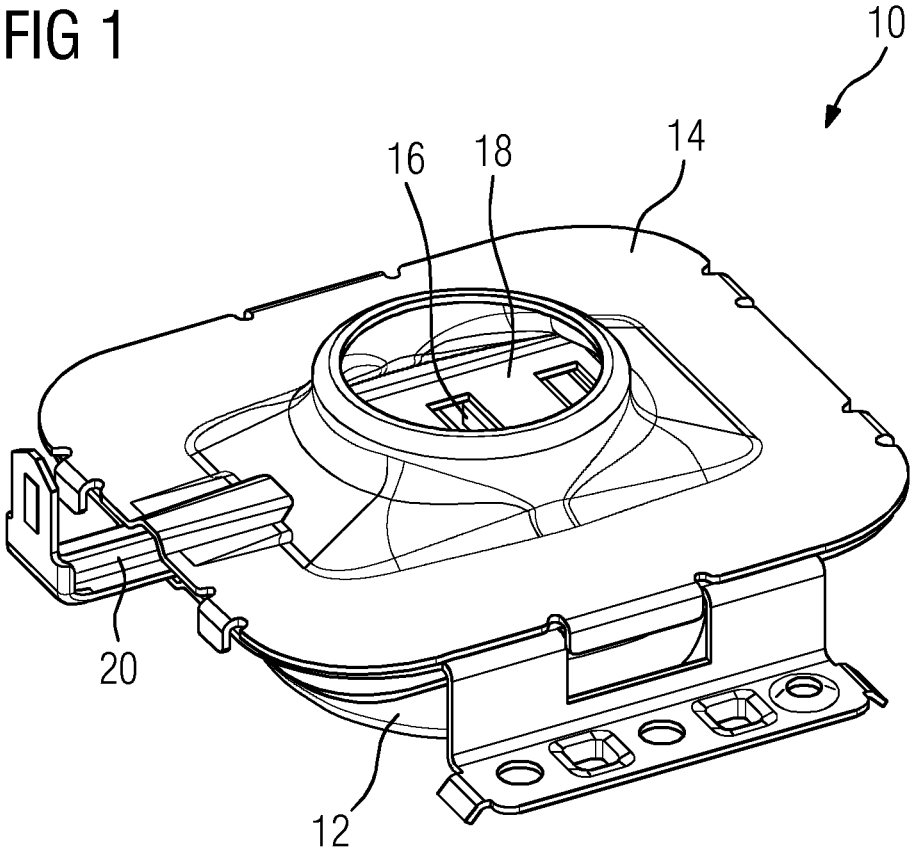

the sliding plate (18) in the closed state, while the at least one opening (28) of the sliding plate (18) is covered by the stationary plate (16) in the closed state. The openings (26, 28) of the stationary plate (16) and the sliding plate (18) overlap at least partially in the opened state. Further, the present invention relates to a cooking oven with at least one exhaust closure system (10).

19 Claims, 8 Drawing Sheets

(58) Field of Classification Search
USPC .... 126/110 A, 285 A, 285 R, 290, 296, 293, 126/504, 533–537
See application file for complete search history.

(56) References Cited

U.S. PATENT DOCUMENTS 3,580,238 A * 5/1971 Diehl ..... F24H 9/2007 126/295
4,136,676 A * 1/1979 McCown ..... F23L 13/02 126/292
4,291,669 A * 9/1981 Herne, Jr. ..... F23M 9/00 110/214
4,355,973 A * 10/1982 Bailey ..... C03B 5/237 126/91 A
4,373,507 A * 2/1983 Schwartz ..... F23G 7/07 126/289
5,014,680 A * 5/1991 Siemer ..... F23B 7/005 110/214
7,784,458 B2 * 8/2010 Richter ..... F23J 13/04 126/80
2007/0221199 A1 * 9/2007 Hake ..... F24C 15/2021 126/299 R
2012/0189489 A1 * 7/2012 Kwon ..... A61L 9/01 422/4
2012/0204852 A1 * 8/2012 Boucher ..... A47J 37/0763 126/30

OTHER PUBLICATIONS

Office action (with translation) issued in corresponding Chinese Patent Application No. 201680036550.6 dated Jan. 2, 2019, 16 pages.

* cited by examiner

EXHAUST CLOSURE SYSTEM FOR A COOKING OVEN

The present invention relates to an exhaust closure system for a cooking oven. Further, the present invention relates to a cooking oven comprising an oven cavity and at least one exhaust channel.

For cooking performance an open exhaust avoids excessive condensation and pressure in an oven cavity. Otherwise, a closed exhaust allows energy saving. Currently, there are cooking ovens having a passive exhaust, which has to compromise between avoiding excessive condensation and pressure on the one hand and energy saving on the other hand. Active exhaust systems are limited in performance, repeatability and operation.

It is an object of the present invention to provide an exhaust closure system for a cooking oven, which avoids excessive condensation and pressure in the oven cavity and allows energy saving by low complexity.

According to the present invention an exhaust closure system is provided for a cooking oven, wherein said exhaust closure system is interconnectable or interconnected between a top wall of an oven cavity and an exhaust channel, and wherein:

the exhaust closure system comprises a lower casing attachable or attached on the top wall of the oven cavity, the lower casing includes at least one inlet opening in its bottom side, the exhaust closure system comprises an upper casing connectable or connected to the exhaust channel, the upper casing includes at least one outlet opening in its top side, the lower casing and the upper casing are permanently or detachably jointed and form a housing of the exhaust closure system, a stationary plate and a sliding plate are arranged inside the housing and between the inlet opening and the outlet opening, the stationary plate and the sliding plate lie against each other, the stationary plate and the sliding plate include at least one opening in each case, the sliding plate is slidable relating to the stationary plate between a closed state and an opened state, the at least one opening of the stationary plate is covered by the sliding plate in the closed state, the at least one opening of the sliding plate is covered by the stationary plate in the closed state, and the openings of the stationary plate and the sliding plate overlap at least partially in the opened state.

The exhaust closure system according to the present invention is provided as a module, i.e. a stand-alone device mountable into the cooking oven. The exhaust closure system can be positioned in a flexible way on the top wall of the oven cavity. In the closed state of the exhaust closure system the energy consumption is minimized. In the opened state of the exhaust closure system condensation is removed from the oven cavity. Thus, the exhaust closure system allows an adjusting of energy consumption and discharging of the condensation, so that the cooking performance can be optimized.

Preferably, the openings of the stationary plate and the sliding plate are congruent or at least substantially congruent to each other. This allows a big variation of the passage through the exhaust closure system by a relative small displacement of the sliding plate.

In particular, the openings of the stationary plate and the sliding plate are slots extending perpendicular to a sliding direction of the sliding plate.

Further, the sliding plate may include a drive arm, wherein preferably the sliding plate and the drive arm are formed as a single-piece part.

For example, the inlet opening and/or the outlet opening are formed as round holes.

Moreover, the inlet opening and/or the outlet opening may have a diameter between 10 mm and 80 mm, preferably between 20 mm and 40 mm, in particular 28 mm.

According to a further embodiment of the present invention, the sliding plate includes at least one steam slot arranged beside the opening and/or between the openings of said sliding plate, wherein the steam slot and the opening of the stationary plate overlap in the closed state, so that a minimum passage between the inlet opening and the outlet opening is provided in the closed state. This embodiment is suitable for a steam cooking oven.

Preferably, the sliding plate is arranged slidably above the stationary plate.

Additionally, the exhaust closure system may comprise at least one catalytic filter element arranged between the lower casing and the stationary plate.

In this case, the exhaust closure system may comprise at least one heat transfer plate arranged below the catalytic filter element. Said heat transfer plate allows a sufficient working temperature for the catalytic filter element.

Further, the present invention relates to a cooking oven comprising an oven cavity and at least one exhaust channel, wherein the cooking oven comprises at least one exhaust closure system mentioned above, wherein said exhaust closure system is interconnected between a top wall of the oven cavity and the exhaust channel.

Moreover, the cooking oven comprises at least one actuator directly or indirectly connected to the sliding plate of the exhaust closure system, wherein said actuator is provided for moving the sliding plate between the closed state and opened state.

In particular, the actuator is connected to the drive arm of the sliding plate via at least one actuator arm.

Preferably, the exhaust closure system and/or the actuator are fixed on the top wall of the oven cavity, preferably by screws.

At last, the cooking oven may comprise at least one external catalytic filter element arranged between the exhaust closure system and an cavity opening in the top wall of the oven cavity.

Novel and inventive features of the present invention are set forth in the appended claims.

Figure 2:
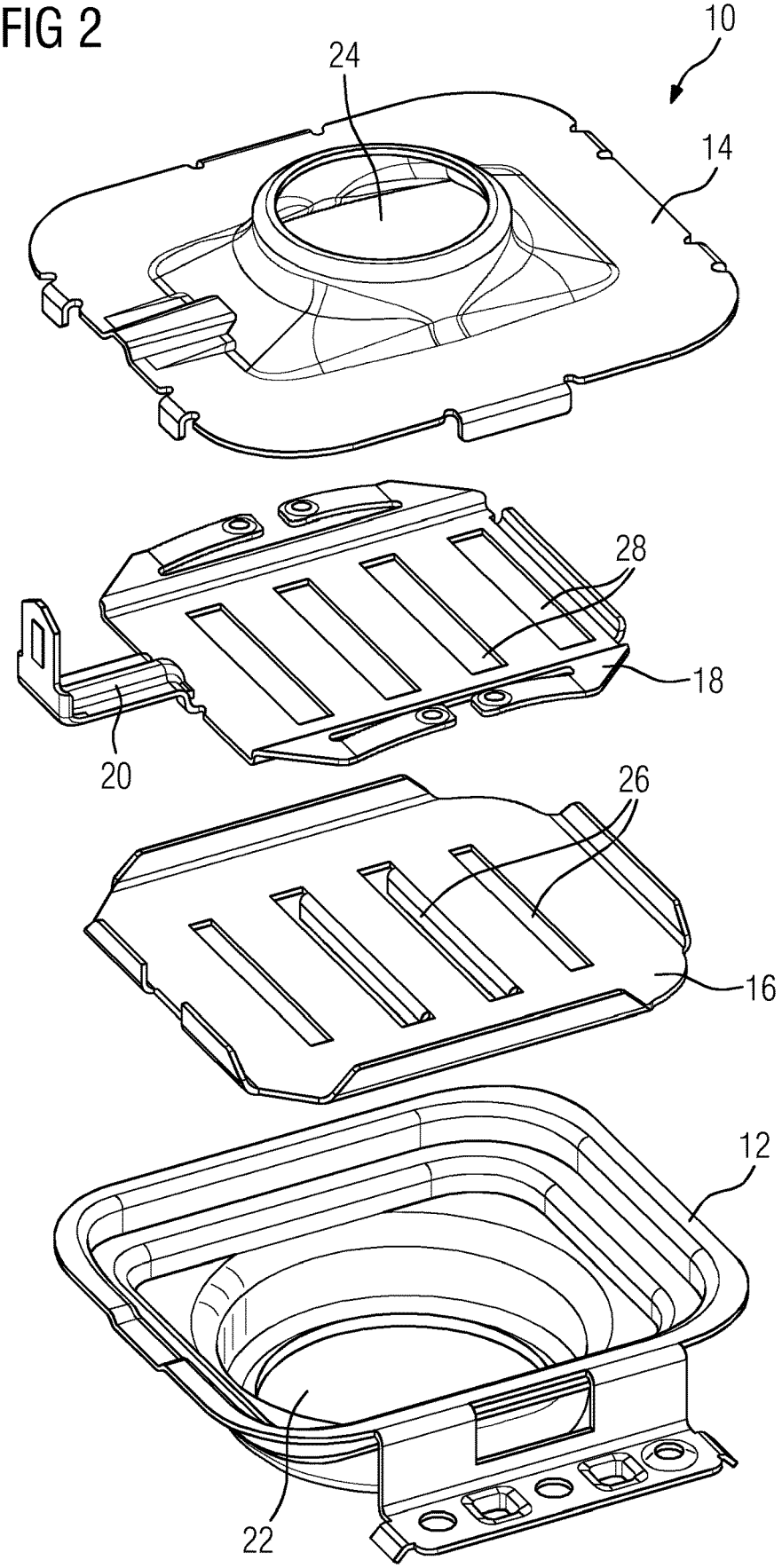
Figure 3:
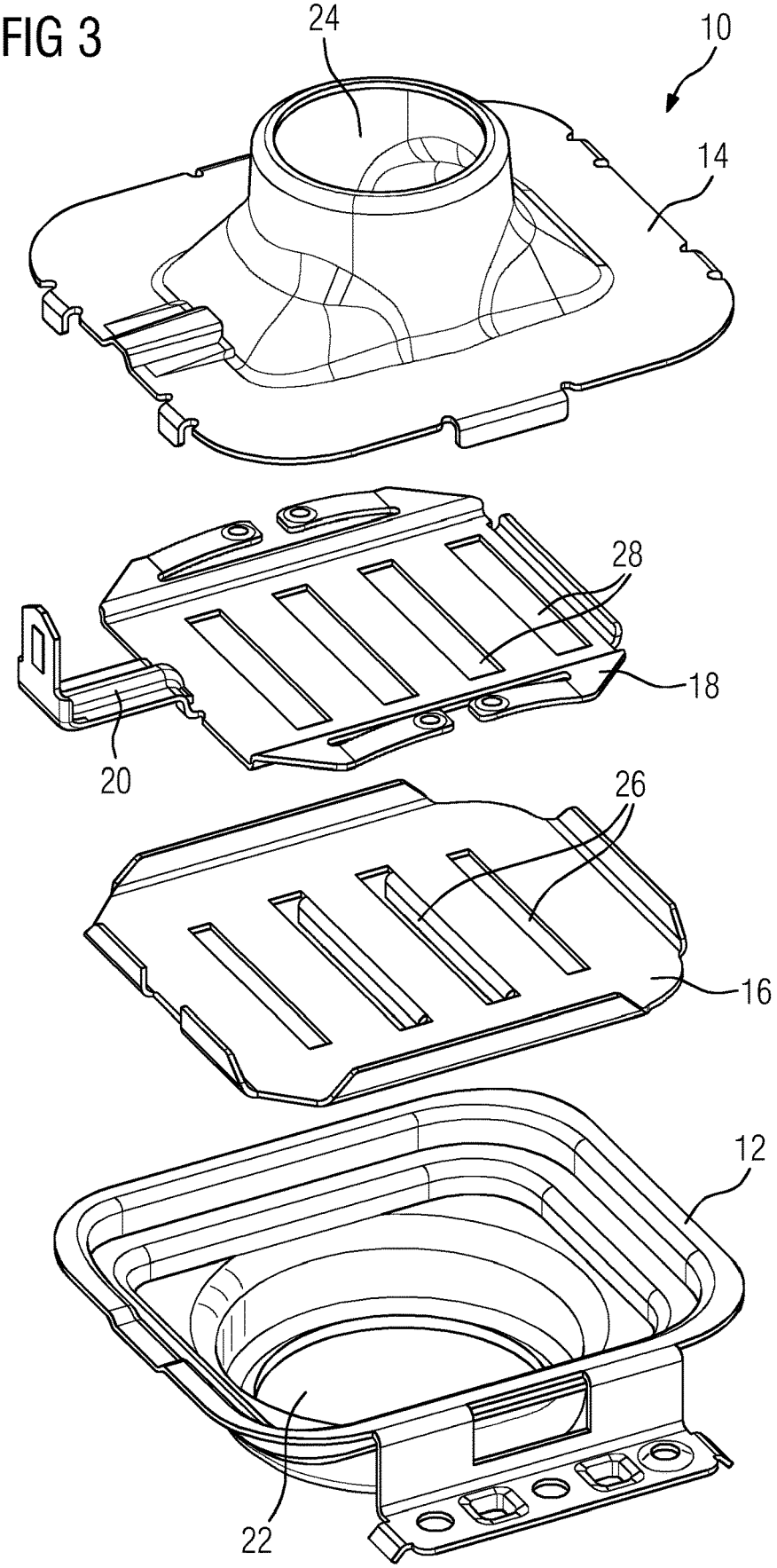
Figure 4:
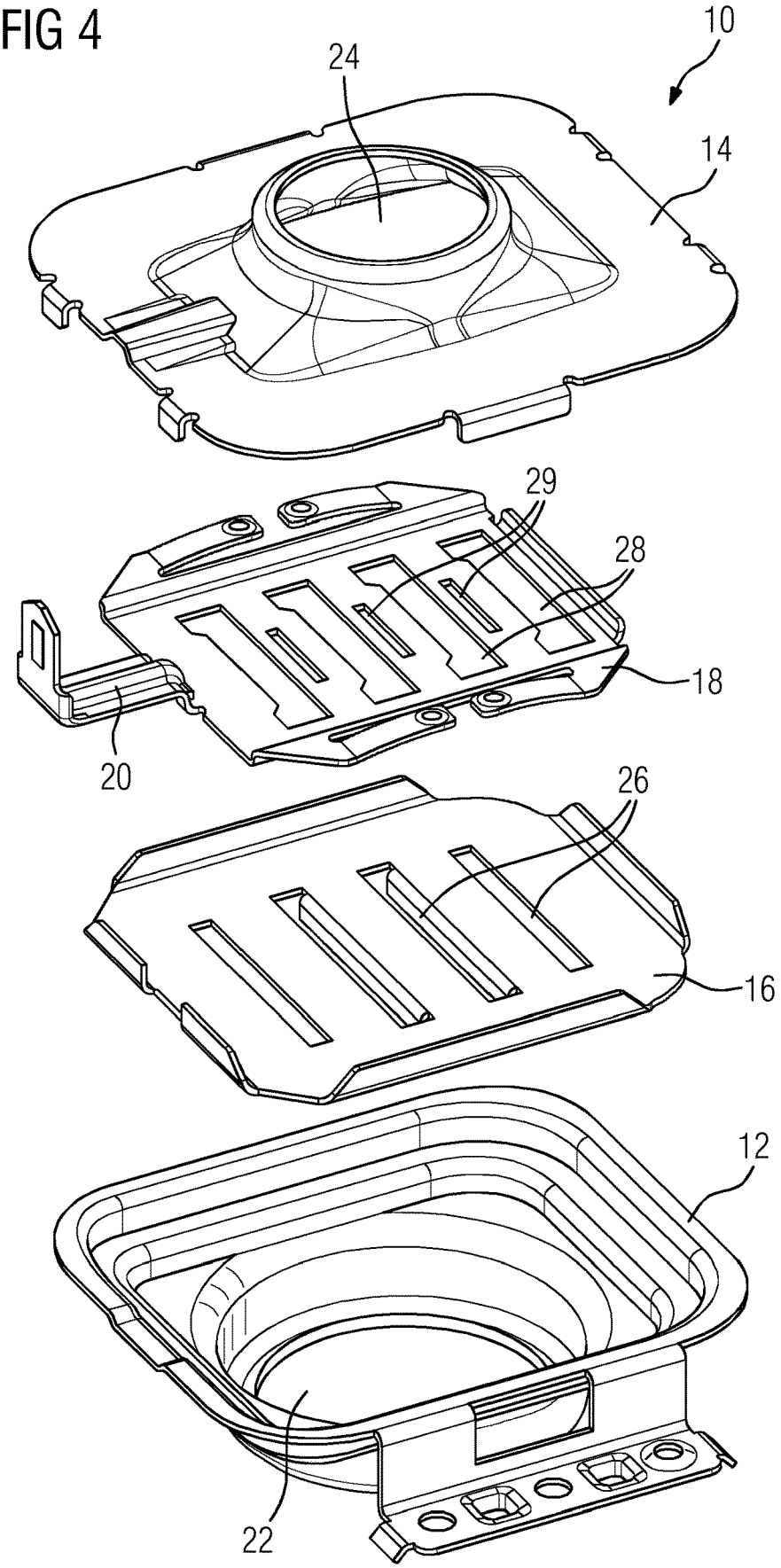
Figure 5:
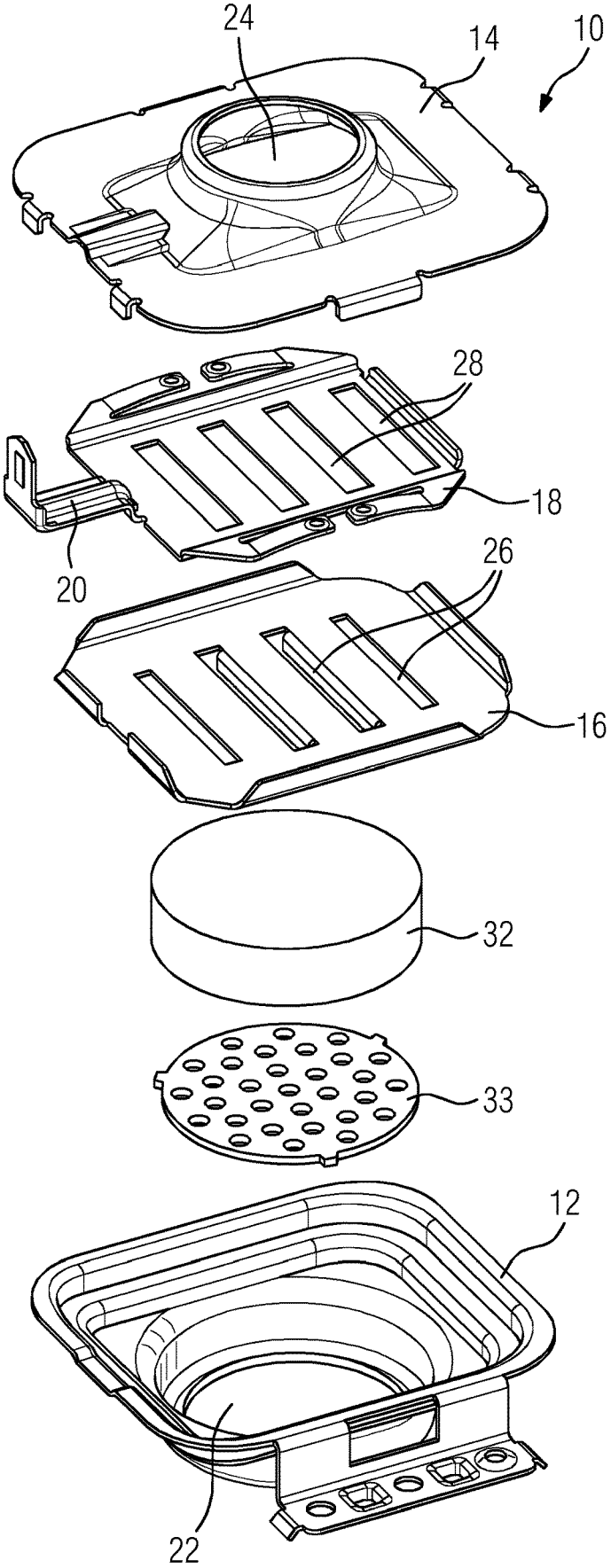
Figure 6:
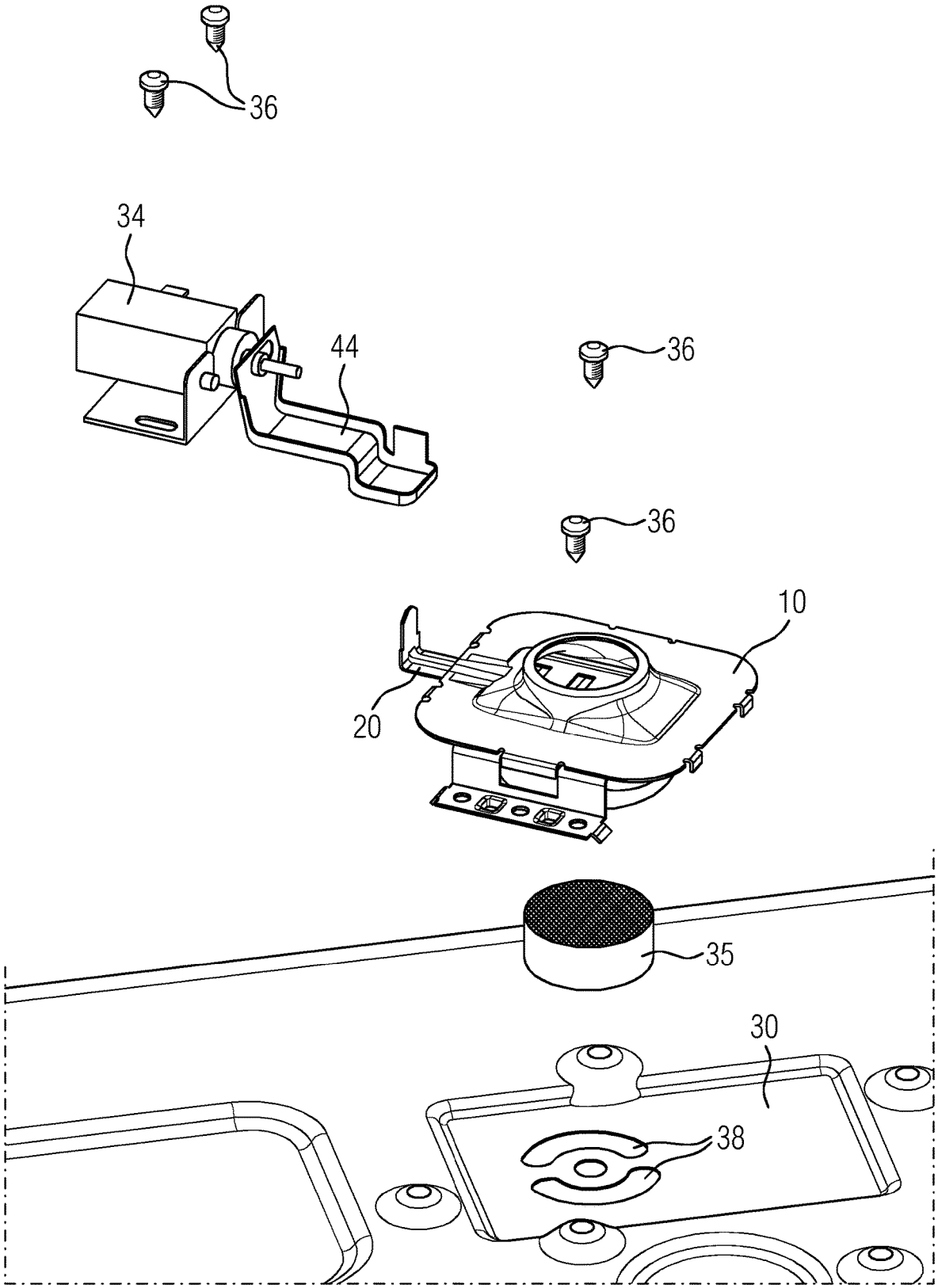
Figure 7:
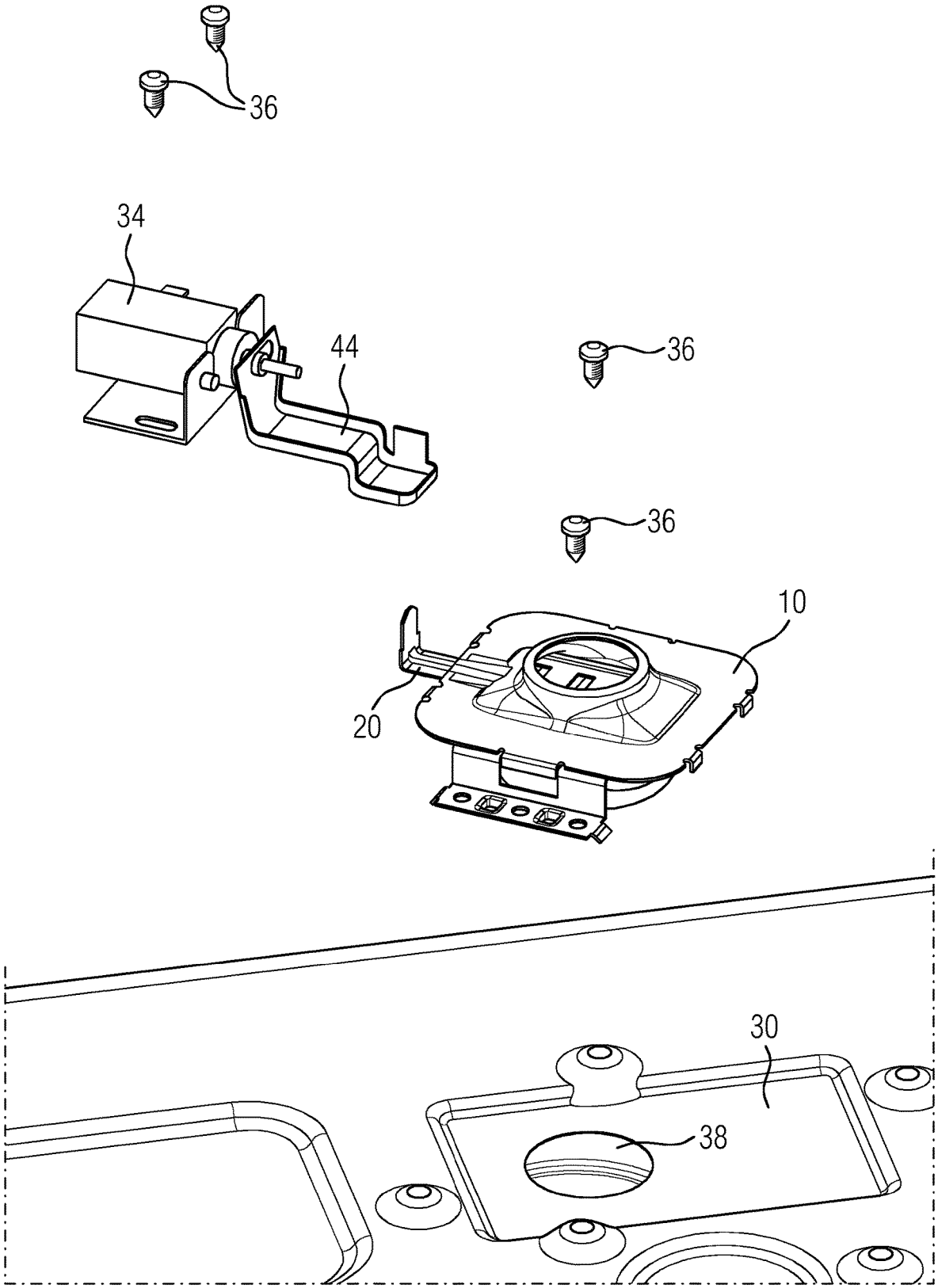
Figure 8:
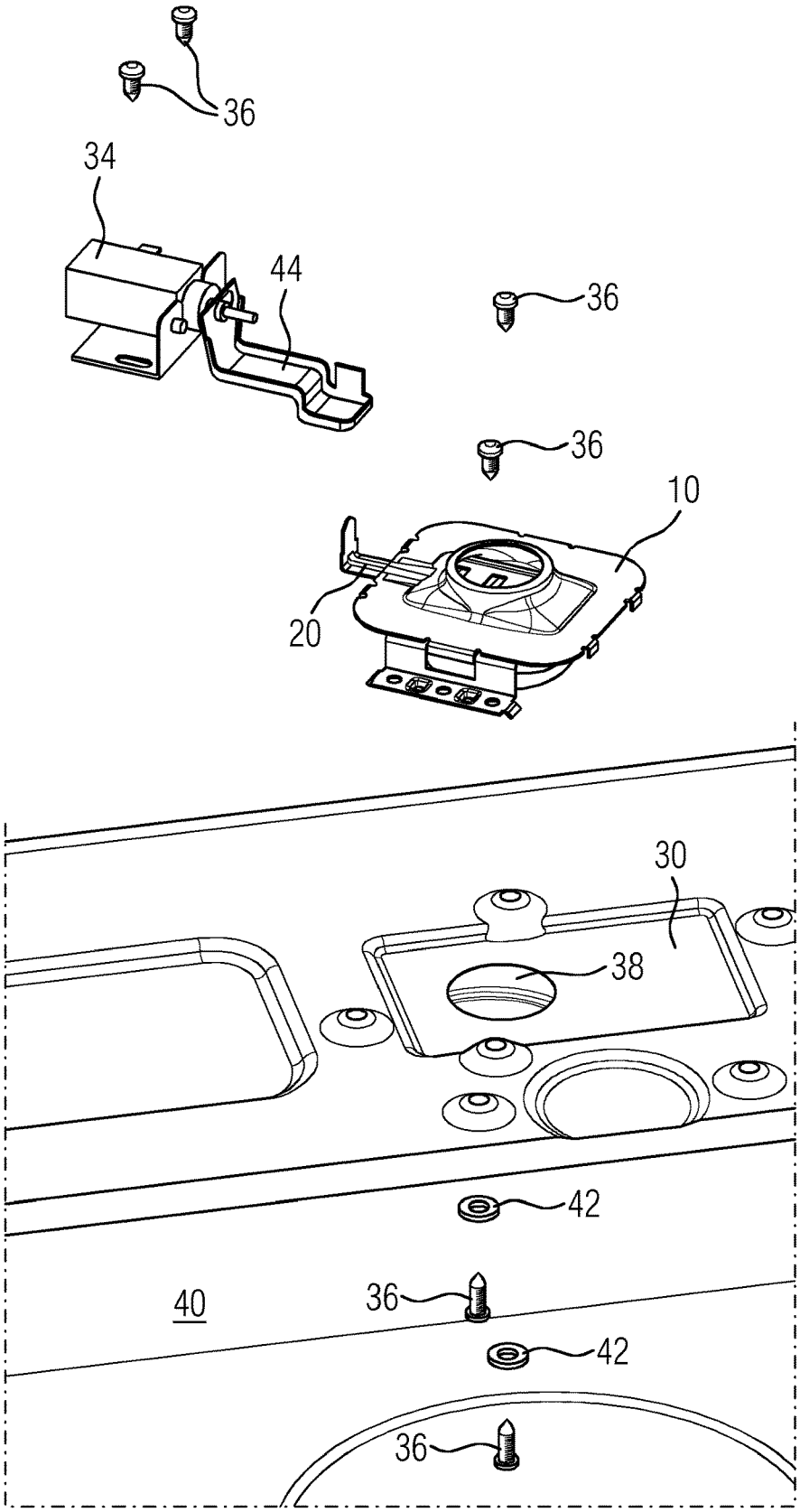

The present invention will be described in further detail with reference to the drawing, in which FIG. 1 illustrates a schematic perspective view of an exhaust closure system according to a first embodiment of the present invention, FIG. 2 illustrates a schematic exploded view of the exhaust closure system according to the first embodiment of the present invention, FIG. 3 illustrates a schematic exploded view of the exhaust closure system according to a second embodiment of the present invention, FIG. 4 illustrates a schematic exploded view of the exhaust closure system according to a third embodiment of the present invention, FIG. 5 illustrates a schematic exploded view of the exhaust closure system according to a fourth embodiment of the present invention, FIG. 6 illustrates a schematic exploded view of the exhaust closure system according to the first embodiment of the present invention arranged on a top wall of an oven cavity according to the first embodiment of the present invention, FIG. 7 illustrates a schematic exploded view of the exhaust closure system according to the fourth embodiment of the present invention arranged on the top wall of the oven cavity, and FIG. 8 illustrates a schematic exploded view of the exhaust closure system according to the fourth embodiment of the present invention arranged on the top wall of the oven cavity.

FIG. 1 illustrates a schematic perspective view of an exhaust closure system 10 according to a first embodiment of the present invention. The exhaust closure system 10 is provided for a cooking oven, wherein said exhaust closure system 10 is interconnectable between a top wall 30 of an oven cavity 40 of the cooking oven and an exhaust channel.

The exhaust closure system 10 comprises a lower casing 12, an upper casing 14, a stationary plate 16 and a sliding plate 18. The lower casing 12 and the upper casing 14 are composed and form a housing of the exhaust closure system 10. The stationary plate 16 and the sliding plate 18 are arranged inside the housing of the exhaust closure system 10. The sliding plate 18 includes a drive arm 20. In this example, the sliding plate 18 and the drive arm 20 are formed as a single-piece part.

Preferably, the lower casing 12, the upper casing 14, the stationary plate 16 and the sliding plate 18 are made of stainless steel. Alternatively, the lower casing 12, the upper casing 14, the stationary plate 16 and/or the sliding plate 18 are made of aluminized steel, e.g. the steel is coated by a layer comprising aluminium and silicone. The stainless steel as well as the aluminized steel allows a low friction between the stationary plate 16 and the sliding plate 18. Further, the stainless steel and the aluminized steel are suitable for high temperatures. For example, in ovens with pyrolytic self-cleaning occur temperature of about 450° C.

FIG. 2 illustrates a schematic exploded view of the exhaust closure system 10 according to the first embodiment of the present invention. The exhaust closure system 10 comprises the lower casing 12, the upper casing 14, the stationary plate 16 and the sliding plate 18.

The lower casing 12 and the upper casing 14 form the housing of the exhaust closure system 10. The lower casing 12 includes an inlet opening 22 at its bottom side. The upper casing 14 into includes an outlet opening 24 at its top side. In this example, the inlet opening 22 and the outlet opening 24 are formed as round hole and have a diameter of 28 mm. The stationary plate 16 and the sliding plate 18 are arranged inside said housing. In this example, the stationary plate 16 and the sliding plate 18 extend in a horizontal plane. The stationary plate 16 is non-relocatably inserted in the lower casing 12. The sliding plate 18 is arranged above the stationary plate 16. The sliding plate 18 is linearly slidable upon the stationary plate 16.

The stationary plate 16 includes a number of openings 26. In a similar way, the sliding plate 18 includes also a number of openings 28. In this example, the openings 26 of the stationary plate 16 as well as the openings 28 of the sliding plate 18 are formed as wide parallel slots, wherein the stationary plate 16 and sliding plate 18 include four slots in each case. Further, the openings 26 of the stationary plate 16 and the openings 28 of the sliding plate 18 are congruent to each other.

The sliding plate 18 is slidable relative to the stationary plate 16 between a closed and an opened state. The sliding plate 18 is slidable along a direction perpendicular to the openings 26 and 28 formed as parallel slots. In the closed state the openings 26 of the stationary plate 16 and the openings 28 of the sliding plate 18 are arranged side-by-side. In the opened state the openings 26 of the stationary plate 16 and the openings 28 of the sliding plate 18 overlap completely or at least substantially completely, so that a passage between the inlet opening 22 and the outlet opening 24 is formed. The sliding plate 18 is continuously slidable between the closed and the opened state, so that the cross-section of the passage between the inlet opening 22 and the outlet opening 24 is steplessly variable.

In the first embodiment the upper casing 14 comprises a short neck, in which the outlet opening 24 is formed. The upper casing 14 with said short neck is adapted to certain types of exhaust channels.

FIG. 3 illustrates a schematic exploded view of the exhaust closure system 10 according to a second embodiment of the present invention. The exhaust closure system 10 according to the second embodiment is substantially the same as that of the first embodiment.

However, the upper casing 14 of the exhaust closure system 10 of the second embodiment comprises a long neck, in which the outlet opening 24 is formed. The upper casing 14 with said long neck is also adapted to certain types of exhaust channels. For example, the upper casing 14 with the short neck is adapted to a double exhaust channel, while the upper casing 14 with the long neck is adapted to a single exhaust channel.

FIG. 4 illustrates a schematic exploded view of the exhaust closure system 10 according to a third embodiment of the present invention. The exhaust closure system 10 according to the third embodiment is substantially the same as that of the first embodiment.

However, the sliding plate 18 of the third embodiment includes steam slots 29 arranged between the openings 28. The steam slots 29 are smaller than the openings 28. In the closed state of the exhaust closure system 10 of the third embodiment, each steam slot 29 and one of the openings 26 of the stationary plate 16 overlap, so that the exhaust closure system 10 remains partially opened in the closed state. The exhaust closure system 10 according to the third embodiment is provided for a steam cooking oven.

In this example, the steam slots 29 are arranged parallel to the openings 28 of the sliding plate 18. In general, the steam slots 29 may have arbitrary shapes, but are always arranged between the openings 28 of the sliding plate 18. For example, instead of one steam slot 29 a series of round holes and/or long holes are formed in the sliding plate 18.

FIG. 5 illustrates a schematic exploded view of the exhaust closure system 10 according to a fourth embodiment of the present invention. The exhaust closure system 10 according to the fourth embodiment is substantially the same as that of the first embodiment.

However, the exhaust closure system 10 of the fourth embodiment comprises additionally a catalytic filter element 32 and a heat transfer plate 33. The catalytic filter element 32 and the heat transfer plate 33 are arranged between the lower casing 12 and the stationary plate 16. The heat transfer plate 33 is arranged above the inlet opening 22 of the lower casing 12. In turn, the catalytic filter element 32 is arranged above the heat transfer plate 33. Preferably, the catalytic filter element 32 is a coated catalytic stone.

FIG. 6 illustrates a schematic exploded view of the exhaust closure system 10 according to the first embodiment of the present invention arranged on the top wall 30 of the oven cavity 40. The exhaust closure system 10 is arranged above a cavity opening 38 formed in the top wall 30 of the oven cavity 40. In this example, the cavity opening 38 includes a number of small openings. An external catalytic filter element 35 is arranged between the cavity opening 38 and the inlet opening 22 of the lower casing 12 of the exhaust closure system 10. Preferably, the external catalytic filter element 35 is a coated catalytic stone.

Further, an actuator 34 is arranged on the top wall 30 of the oven cavity 40. The actuator 34 is provided for driving the sliding plate 18 of the exhaust closure system 10. In this example, the actuator 34 is an electric actuator. An actuator arm 44 is interconnected between the actuator 34 and the drive arm 20 of the sliding plate 18. The shape of the actuator arm 44 is adapted to the geometric properties of the environment. Further, the actuator 34 should be spaced from the top wall 30 of the oven cavity 40, since the temperature decreases with the distance from the top wall 30. In this example, the actuator 34 includes a step. In general, the actuator 34 has a shape allowing a sufficient distance of the actuator 34 from the top wall 30 of the oven cavity 40. The actuator 34 and the exhaust closure system 10 are fastened by screws 36 on the top wall 30 of the oven cavity 40.

FIG. 7 illustrates a schematic exploded view of the exhaust closure system 10 according to the fourth embodiment of the present invention on the top wall 30 of the oven cavity 40. The exhaust closure system 10 according to the fourth embodiment comprises the catalytic filter element 32 and the heat transfer plate 33. In this example, the cavity opening 38 is formed as one round hole.

The actuator 34 is provided for driving the sliding plate 18 of the exhaust closure system 10. The actuator 34 and the exhaust closure system 10 are fastened by screws 36 on the top wall 30 of the oven cavity 40.

FIG. 8 illustrates a schematic exploded view of the exhaust closure system 10 according to the fourth embodiment of the present invention on the top wall 30 of the oven cavity 40. The exhaust closure system 10 according to the fourth embodiment comprises the catalytic filter element 32 and the heat transfer plate 33. In this example, the cavity opening 38 is formed as one round hole.

The actuator 34 is provided for driving the sliding plate 18 of the exhaust closure system 10. The actuator 34 is fastened by screws 36 on the top wall 30 of the oven cavity 40, wherein said screws 36 are fastened from the top side of the top wall 30. In contrast, the exhaust closure system 10 is fastened by screws 36 and lining discs 42 on the top wall 30 of the oven cavity 40, wherein said screws 36 and lining discs 42 are fastened from the bottom side of the top wall 30.

The exhaust closure system 10 according to the present invention is provided as a module. Thus, the exhaust closure system 10 can be positioned in a flexible way on the top wall 30 of the oven cavity 40. In the closed state of the exhaust closure system 10 the energy consumption is minimized. In the opened state of the exhaust closure system 10 condensation is removed from the oven cavity 40. Thus, the exhaust closure system 10 allows an adjusting of energy consumption and discharging of the condensation, so that the cooking performance can be optimized.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 exhaust closure system
12 lower casing
14 upper casing
16 stationary plate
18 sliding plate
20 drive arm
22 inlet opening
24 outlet opening
26 opening of the stationary plate
28 opening of the sliding plate
29 steam slot
30 top wall of the oven cavity
32 catalytic filter element
33 heat transfer plate
34 actuator
35 external catalytic filter element
36 screw
38 cavity opening
40 oven cavity
42 lining disc
44 actuator arm

The invention claimed is:

1. An exhaust closure system for a cooking oven, wherein said exhaust closure system is interconnectable or interconnected between a top wall of an oven cavity and an exhaust channel, and wherein:

the exhaust closure system comprises a lower casing attachable or attached on the top wall of the oven cavity, the lower casing includes at least one inlet opening in its bottom side, the exhaust closure system comprises an upper casing connectable or connected to the exhaust channel, the upper casing includes at least one outlet opening in its top side, the lower casing and the upper casing are permanently or detachably jointed and form a housing of the exhaust closure system, a stationary plate and a sliding plate are arranged inside the housing and between the inlet opening and the outlet opening, the stationary plate and the sliding plate lie against each other, each of the stationary plate and the sliding plate includes at least one opening, the sliding plate is slidable relating to the stationary plate between a closed state and an opened state, the at least one opening of the stationary plate is covered by the sliding plate in the closed state, the at least one opening of the sliding plate is covered by the stationary plate in the closed state, the openings of the stationary plate and the sliding plate overlap at least partially in the opened state, the upper casing includes at least one neck in which the outlet opening is formed, and at least one catalytic filter element is arranged between the lower casing and the stationary plate.

2. The exhaust closure system according to claim 1, wherein the openings of the stationary plate and the sliding plate are congruent or at least substantially congruent to each other.

3. The exhaust closure system according to claim 1, wherein the openings of the stationary plate and the sliding plate are slots extending perpendicular to a sliding direction of the sliding plate.

4. The exhaust closure system according to claim 1, wherein the sliding plate includes a drive arm.

5. The exhaust closure system according to claim 1, wherein the inlet opening and/or the outlet opening is/are formed as round holes.

6. The exhaust closure system according to claim 1, wherein the inlet opening and/or the outlet opening have/has a diameter between 10 mm and 80 mm.

7. The exhaust closure system according to claim 1, wherein the sliding plate includes at least one steam slot arranged beside the opening and/or between the openings of said sliding plate, wherein the steam slot and the opening of the stationary plate overlap in the closed state, so that a minimum passage between the inlet opening and the outlet opening is provided in the closed state.

8. The exhaust closure system according to claim 1, wherein the sliding plate is arranged slidably above the stationary plate.

9. The exhaust closure system according to claim 1, wherein the exhaust closure system comprises at least one heat transfer plate arranged below the catalytic filter element.

10. A cooking oven comprising an oven cavity and at least one exhaust channel, wherein the cooking oven comprises at least one exhaust closure system according to claim 1, wherein said exhaust closure system is interconnected between a top wall of the oven cavity and the exhaust channel.

11. The cooking oven according to claim 10, wherein the cooking oven comprises at least one actuator directly or indirectly connected to the sliding plate of the exhaust closure system, wherein said actuator is provided for moving the sliding plate between the closed state and opened state.

12. The cooking oven according to claim 10, wherein the actuator is connected to the drive arm of the sliding plate via at least one actuator arm.

13. The cooking oven according to claim 10, wherein the exhaust closure system and/or the actuator is/are fixed on the top wall of the oven cavity.

14. The cooking oven according to claim 10, wherein the cooking oven comprises at least one external catalytic filter element arranged between the exhaust closure system and a cavity opening in the top wall of the oven cavity.

15. The exhaust closure system according to claim 4, said drive arm and said sliding plate being formed as a single-piece part.

16. The exhaust closure system according to claim 6, said diameter being between 20 mm and 40 mm.

17. An exhaust closure system for a cooking oven, comprising:

a lower casing having an inlet opening therein and an upper casing having at least one neck in which an outlet opening is formed, said lower and upper casings together forming a housing;

a sliding plate having a first opening therein and a stationary plate having a second opening therein disposed within said housing, said sliding plate being arranged adjacent to and linearly slidable upon the stationary plate between an open state and a closed state for said closure system;

said first and second openings having a maximum degree of overlap to establish a maximum degree of fluid communication from said inlet opening, through each of said first and second openings in the respective sliding and stationary plates and out said outlet opening in said open position, and said first and second openings having no overlap in said closed state;

said sliding plate being continuously slidable via an actuator so that a cross-section of a passage defined by the degree of overlap between said first and second openings is steplessly variable between the open and closed states in order to steplessly vary the degree of fluid communication up to said maximum degree;

said closure system being a modular component that can be independently installed in a cooking oven with its inlet opening in communication with an oven cavity of the cooking oven, and its outlet opening in communication with an exhaust channel of the cooking oven; and a catalytic filter element arranged between said lower casing and said stationary plate, above said inlet opening.

18. The exhaust closure system according to claim 17, said sliding plate further comprising a steam slot smaller than and arranged adjacent to said first opening, said steam slot being aligned such that in said closed state the steam slot overlaps with said second opening in the stationary plate.

19. The exhaust closure system according to claim 18, further comprising a heat transfer plate arranged between said lower casing and said stationary plate, above said inlet opening.

* * * * *